United States Patent [19]

Buckenauer

[11] Patent Number: 4,685,825

[45] Date of Patent: Aug. 11, 1987

[54] DEVICE FOR USE IN EXPANSION JOINTS

[75] Inventor: Günter Buckenauer, Baldham, Fed. Rep. of Germany

[73] Assignee: Friedrick Maurer Sohne GmbH & Co. KG, Munich, Fed. Rep. of Germany

[21] Appl. No.: 851,272

[22] Filed: Apr. 10, 1986

Related U.S. Application Data

[63] Continuation of Ser. No. 608,370, May 9, 1984, abandoned.

[51] Int. Cl.[4] ..... E01C 11/12

[52] U.S. Cl. ..... 404/65; 404/68; 52/396

[58] Field of Search ..... 404/47, 56, 64, 65, 404/67-69; 14/16.5; 49/489; 52/396, 403, 573

[56] References Cited

U.S. PATENT DOCUMENTS

| | | | |
|---|---|---|---|
| 2,220,628 | 11/1940 | Stedman | 404/47 |
| 3,363,383 | 1/1968 | La Barge | 404/68 X |
| 3,765,784 | 10/1973 | Watson et al. | 404/64 |
| 3,797,188 | 3/1974 | Mansfeld | 404/47 X |
| 4,148,167 | 4/1979 | Puccio | 404/65 X |
| 4,290,713 | 9/1981 | Brown et al. | 49/489 X |
| 4,362,428 | 12/1982 | Kerschner | 404/64 |
| 4,457,522 | 7/1984 | Trieste et al. | 404/64 X |

FOREIGN PATENT DOCUMENTS

| | | | |
|---|---|---|---|
| 2516427 | 10/1976 | Fed. Rep. of Germany | 14/16.5 |
| 2549041 | 5/1977 | Fed. Rep. of Germany | 404/69 |
| 2104122 | 3/1983 | United Kingdom | 404/56 |
| 2151276 | 7/1985 | United Kingdom | 404/69 |
| 2158120 | 11/1985 | United Kingdom | 404/69 |

*Primary Examiner*—Stephen J. Novosad
*Assistant Examiner*—John F. Letchford
*Attorney, Agent, or Firm*—Birch, Stewart, Kolasch & Birch

[57] ABSTRACT

A device for use in expansion joints in ramps, bridges, sidewalks, floors of multi-story car parks and the like having at least one cellular sealing strip made of an elastic material which when installed is supported on two opposite sides of the expansion joint. The strip has a number of planar faces that are at all times alined in a single common plane to form the top side of the sealing strip in every working condition thereof. Thus the top side of the strip is always planar no matter to what extent it is compressed or stretched. The webs forming the walls of the cells converge or diverge in relation to each other.

17 Claims, 6 Drawing Figures

DEVICE FOR USE IN EXPANSION JOINTS

This application is a continuation, divisional, continuation-in-part, of application Ser. No. 608,370 filed on May 9, 1984 now abandoned.

BACKGROUND OF THE INVENTION.

The present invention relates to devices for bridging over expansion joints in ramps, bridges, sidewalks, floors of multi-story car parks and the like with at least one expansible cellular band made of an elastic material that is supported on the two sides of the joint gap.

DISCUSSION OF THE PRIOR ART.

In the prior art one device of this sort has been designed in the form of a sealing strip having means on its sides adapted to be fixed in position by gripping cleats on the side of the joint or in holding means. In the middle of its cross section such sealing strip was molded with a horizontal channel to make it simpler for the sealing strip to be compressed or collapsed when the sides of the joint moved closer together. In the case of another prior design for spanning a joint gap the sealing strip was generally in the nature of a hollow body with deforming cells to facilitate the collapse or folding up of the hollow body when there was a decrease in the size of the joint gap.

A shortcoming to be experienced with both prior systems is however that the sealing strips sag and sink down into the joint gap so as to be lower than the level of the tops of the sides of the joint, such sagging being more pronounced the greater the width of the gap. Furthermore the strip may take up a position above the said level or both forms of misarrangement may be present at the same time, so that there is, on the one hand a certain danger for persons walking along such sidewalks or the like and on the other hand sunken parts of the strips will act as dirt traps and such dirt will shorten the working life of the sealing strip.

SHORT OUTLINE OF THE INVENTION

For this reason one purpose of the present invention is to so design and further develop a device of the sort in question that there will be no danger to persons walking or driving over devices whatever the position the joints are in.

A still further object or aim of the present invention is to put a stop, as far as possible, to the building up of deposits of dirt whatever the breadth of the joint gap.

To effect these and other purposes of the present invention the top side of the sealing strip is made up of a number of interconnected planar faces alined in a single plane whatever the working position of the strip.

This design of the strip in keeping with the present invention makes certain that the top face of the gap spanning means will be even at all times, that is to say, so that it will normally be alined with the horizontal whatever the degree of compression or stretching, as for example when the strip is partially or fully stretched out or compressed. This being the case, the danger of an accidents is greatly cut down. More specially there is provided a smooth transition at the sides of the joint gap. Lastly, when it rains no puddles will be formed that might freeze in cold weather. A further effect of the gap spanning or filling means of the invention is that there will be generally no build-up of dirt deposits on the sealing strip whatever the state of the joint, such deposits otherwise being generally likely to be the cause of strip deterioration. The sealing strip is firmly kept in place at the edge in specially designed holding means that are of such nature that they as well are lined up with the top face of the sealing strip.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
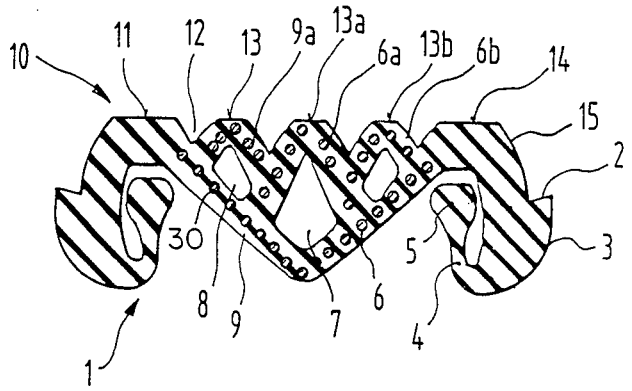
FIG. 1 is a view of one form of the sealing strip in cross section before being installed in a joint gap.

DETAILED DESCRIPTION OF THE INVENTION.

The gap filling or sealing strip 1 viewed in cross section has a middle part whose structure is characterized by being made up generally of cells of special design. All the webs or cell walls 6, 6*a*, 6*b*, 9 and 9*a* are placed so as to be diverging from or converging towards each other so that in the middle part a cell 7 is formed with the cross section of an equilateral rhomb with the one apex of this quadrilateral pointing towards the flat or planar face 13*a*. On either side of such cell and next to it there are the cells 8, that in cross section have the form of a quadrilateral. In the present example each such quadrilateral is generally in the form of a trapezoid with sides of unequal length, one apex thereof again pointing towards the planar face 13 in the one case and 13*b* in the other.

The planar faces 13 and 13*b* are associated with the further planar faces 11 and 14. All the planar faces are in one single plane and are separated from each other by short notches 12. Such notches are advantageously best v-like in form.

At the edges the planar faces 11 and 14 run into edge webs 15, which extends into seat or abutment faces 2 with outwardly formed lips 3 disposed at a lower level than the planar faces. The lips 3 extend into relatively thin, springy feathers or edges 4 that fold inwards so as to point towards the planar faces 11 and 14. At their ends the feathers 4 are provided with beads 5 that may be made of resilient material if desired.

The sealing strip 1 is fixed or locked in holding means 17 that are put in place on both sides along the edges of the material 16 in which the joint gap is made. This holding means 17 is generally u-like in form, the longer leg 18 thereof running out generally as far as the top face 10 of the installed sealing strip 1, where said leg is bent back around down onto itself and forming a hook-like head 19 whose free edge takes the form of a locking ledge for the abutment face 2 of the sealing strip 1.

The opposite leg 20 is made somewhat shorter in length and may converge a little towards the longer leg 18. The lips 3, the resilient feather 4 and the bead 5 (see FIG. 2) are nested within the bay 29 formed by the legs 18 and 20 so that the sealing strip 1 is locked in place with a force fit and may not be dislodged or lifted out of position without special-purpose tools.

The holding means 17 has an anchoring means, which in the present working example is in the form of a rail 21 welded to the outer bottom part of the holding means 17 so as to be running out with tucked-round edge into the material 16 to either side of the joint gap. In place of this design it would however be possible for other known forms of anchoring means to be used with the holding means 17.

Figure 2:
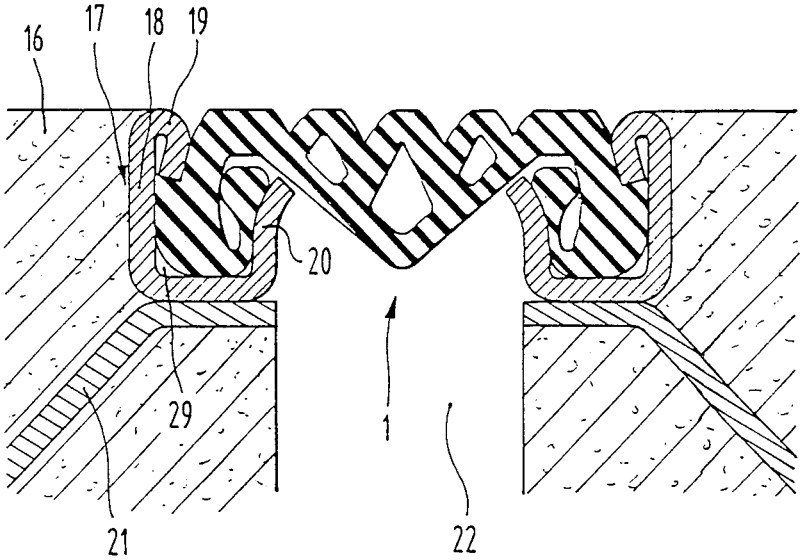
FIG. 2 is a view of the sealing strip as seen in FIG. 1 after being fixed in place between the side faces of the joint gap, the gap being in a wide condition.
Figure 3:
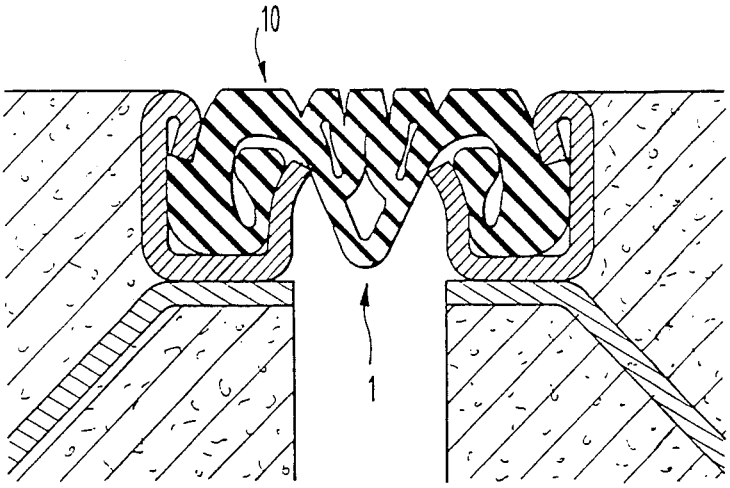
FIG. 3 is a view of the sealing strip of FIG. 2 generally in its maximum state of compression.

It will be seen from FIGS. 2 and 3 that the top face 10 of the sealing strip or band 1 is always alined with the top edge of the sides of the joint gap in the material 16. The recurrent head 19 or hook of the holding means 17 is lined up in this plane as well so that an even face is produced that but for the short notches 12 is generally unbroken, such notches not destroying the plane-lke nature of the said top face.

This form of the invention may be looked upon as a simple, low-price means for spanning or bridging over a joint gap. Depending on the loading to be experienced the webs or the cell walls forming the planar faces may be reinforced, as for example by having reinforcing ribs 30 or the like, or by having metal or non-metallic reinforcements therein.

Figure 4:
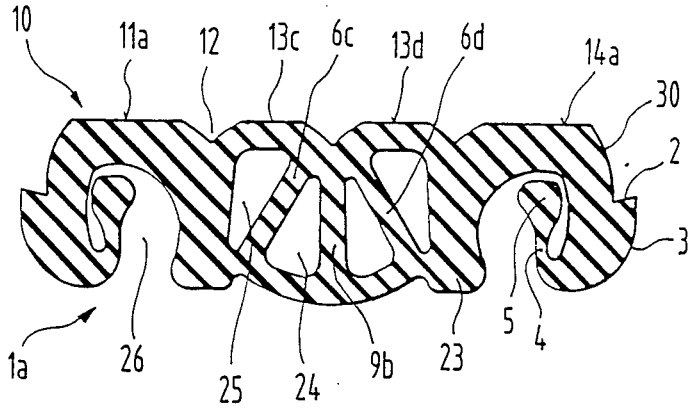
FIG. 4 is a view of a further embodiment of the sealing band or strip in cross section before the installation thereof.
Figure 5:
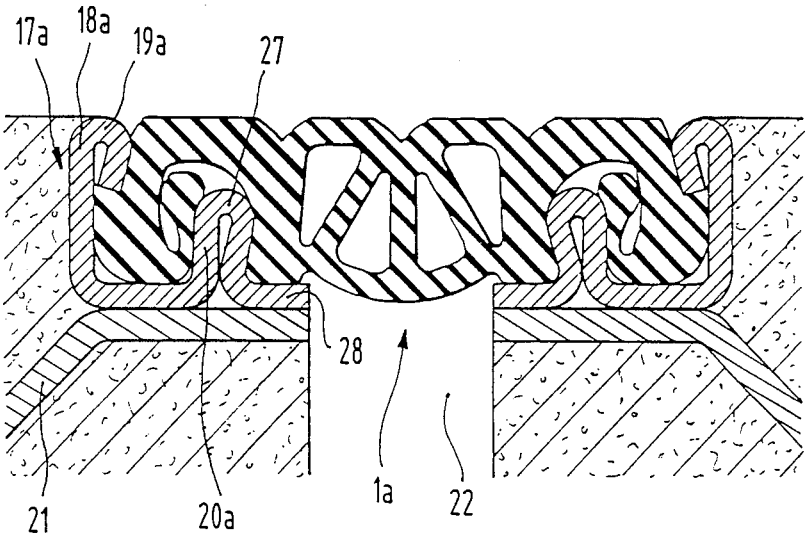
FIG. 5 is a view of the strip of FIG. 4 after being fixed in place between the sides of the joint gap, with the strip being fully extended.
Figure 6:
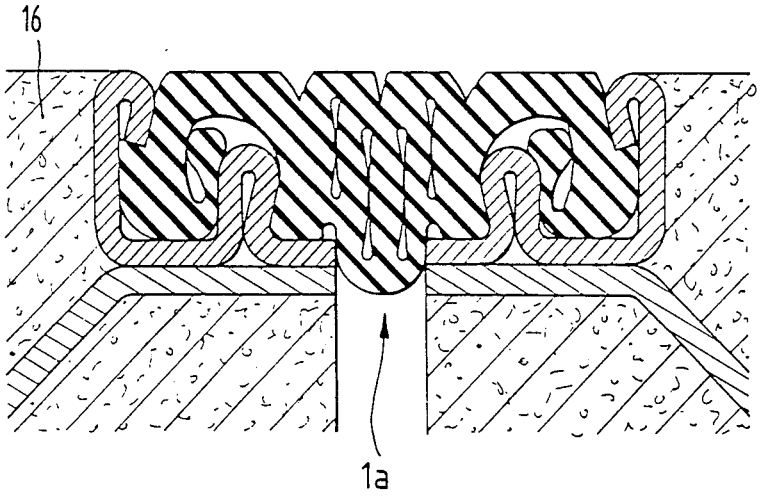
FIG. 6 is a view of the strip of FIG. 5 in its state of maximum compression.

A further form of the device of the present invention may be seen in FIGS. 4 to 6. In the middle part the sealing strip is in this case made with cells 24 and 25. The two cells 24 placed next to each other have a triangular cross section with the apex of the triangle pointing towards the top face of the strip, whereas the two cells with a triangular cross section adjacent thereto have their bases facing the top. The top face 10 is formed by the two middle planar faces 13*c* and 13*d*, that are next to the planar faces 11*a* and 14*a*. The webs 23 or cell walls to the side thereof are made especially thick and join up with upper webs 30. In this case as well there is an abutment face 2 or ledge, and a lip 3 extending out into a feather 4 that becomes thinner and thinner in cross section, and turns upwards, pointing toward the planar face 11*a* or 14*a*. At the end of the feather 4 or edge has a bead 5.

This sealing strip is locked in position in quite the same way as the strip seen in FIG. 1, the only difference being that the short leg 20*a* is looped around, forming the fold 27. The free end of the fold or head 27 points downwards and is bent out at a right angle to form the leg 28. In this case as well there is an anchor 21 locked in place in the concrete material 16 which forms the side of the joint gap 22.

In the case of this device as well, see FIG. 6, the sealing strip 1*a* when compressed runs smoothly up to the edges of the joint gap in the material 16 in one plane therewith.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A device for bridging an expansion joint gap in a structure, said joint gap being subject to change in the width thereof, said device comprising substantially u-shaped reinforcement holding means disposed in the structure at opposite sides of the joint gap, said reinforcement holding means being provided with a short inner leg and a longer outer leg with the open mouth of the u-shaped configuration facing the top of the joint gap, said outer leg being turned on itself at its end portion thereof to take the form of a hook-like head having an engaging surface facing opposite to said open mouth, at least one cellular expansive strip of elastic material adapted to be supported on the opposite sides of said joint gap, said strip having an upper side made up of interconnected planar faces that are always aligned in a single plane whenever the working state of the said strip, said planar faces being adapted to maintain their alignment with the top edges of the sides of the said joint gap notwithstanding any changes in the width of the said joint gap taking place because of expansion and contraction thereof, said device having edge webs on each side of said cellular expansion strip, said edge webs extending to a lower level than said planar faces and having outwardly directed abutment faces at least one of said abutment faces facing opposite to and engaging said engaging surface of said hook-like head, said abutment faces being formed into lips, each such lip extending in the form of a feather or edge that becomes thinner in the direction removed from said lip, said feather pointing inwardly toward the top side of the strip and terminating in a bead molded thereon, said bead producing elastic lateral contact pressures and sealing by virtue of a wedging effect said edge webs being compressively disposed within the u-shaped reinforcement holding means thereby locking the edge webs in place with a force fit.

2. The device as claimed in claim 1, wherein said edge webs are thicker than the webs disposed between cells in the middle of said strip.

3. The device as claimed in claim 1 comprising metal reinforcing means disposed in at least some positions of the cross section of the strip under the said planar faces.

4. The device as claimed in claim 1 comprising reinforcing means made of a material other than metal disposed in at least some positions of the cross section of the strip under said planar faces.

5. The device as claimed in claim 1 wherein said inner leg is bent in the form of a looped head.

6. The device as claimed in claim 1 wherein said planar faces are separated from each other by notches of constant cross section so that there is a distance between said planar faces.

7. The device as claimed in claim 6 wherein said notches of constant cross section run in the longitudinal direction of said joint gap in which said strip is to be installed.

8. The device as claimed in claim 1 comprising a substantially u-shaped holding means with a short inner leg and a longer outer leg, said outer leg being turned on itself at its end portion thereof to take the form of a crimped head as a support for said abutment faces.

9. The device as claimed in claim 8 wherein said inner leg is adapted for supporting said bead as a counter-abutment therefor.

10. The device as claimed in claim 1 wherein said holding means is designed with an anchoring means as a part thereof.

11. The device as claimed in claim 10 wherein said anchoring means is in the form of a piece of bent sheet metal.

12. The device as claimed in claim 1 having webs running from said planar faces, said webs forming walls between the cells in said strip, said webs being at an angle to each other and with a changing distance between one web and the web adjacent thereto.

13. The device as claimed in claim 12 having a middle cell that is deltoid in form and having cells with a quadrilateral cross section on both side thereof.

14. The device as claimed in claim 12, having a plurality of cells of a generally acutely pointed triangular cross section, two such cells being middle cells with their apexes pointing toward said planar faces, and two additional cells disposed laterally to the middle cells and having their bases facing said planar faces.

15. The device as claimed in claim 12 wherein all webs are of the same thickness.

16. The device as claimed in claim 3 comprising reinforcing means disposed in at least some of said webs.

17. The device as claimed in claim 16 wherein said inner leg diverges with respect to said outer leg.

* * * * *